US005871046A

United States Patent [19]

Robison

[11] Patent Number: 5,871,046

[45] Date of Patent: Feb. 16, 1999

[54] ORIENTING, RETRIEVABLE WHIPSTOCK ANCHOR

[75] Inventor: Clark Edward Robison, Plano, Tex.

[73] Assignee: Halliburton Energy Services, Inc., Dallas, Tex.

[21] Appl. No.: 912,996

[22] Filed: Aug. 11, 1997

Related U.S. Application Data

[63] Continuation of Ser. No. 367,483, Dec. 30, 1994, abandoned, which is a continuation of Ser. No. 186,346, Jan. 25, 1994, abandoned.

[51] Int. Cl.[6] ..... E21B 7/08

[52] U.S. Cl. ..... 166/241.1; 166/380; 166/382; 166/117.6; 175/61

[58] Field of Search ..... 166/50, 117.6, 166/382, 117.5, 380, 241.1, 384; 175/61

[56] References Cited

U.S. PATENT DOCUMENTS

| | | | |
|---|---|---|---|
| 1,923,448 | 8/1933 | McCoy et al. | 255/1 |
| 2,100,684 | 11/1937 | Carroll | 255/1 |
| 2,105,722 | 1/1938 | Barrett et al. | 255/1 |
| 2,147,544 | 2/1939 | Potts | 255/28 |
| 2,173,035 | 9/1939 | Armentrout et al. | 175/82 X |
| 2,207,920 | 7/1940 | Hughes | 255/1 |
| 2,211,803 | 8/1940 | Warburton | 255/1 |
| 2,327,658 | 8/1943 | Miller | 255/1.6 |
| 2,452,920 | 11/1948 | Gilbert | 255/1.6 |
| 2,647,584 | 8/1953 | Baker et al. | 166/12 |
| 2,691,507 | 10/1954 | Brown | 255/1.6 |
| 2,844,357 | 7/1958 | Ring | 255/1.6 |
| 2,858,107 | 10/1958 | Colmerauer | 255/1.6 |
| 2,953,350 | 9/1960 | Moore | 255/1.6 |
| 3,052,309 | 9/1962 | Eastman | 175/45 |
| 3,095,039 | 6/1963 | Kinzbach | 166/117.6 |
| 3,115,935 | 12/1963 | Hooton | 166/117.6 |
| 3,122,213 | 2/1964 | Hawk | 175/45 |
| 3,208,355 | 9/1965 | Baker et al. | 91/411 |
| 3,908,759 | 9/1975 | Cagle et al. | 166/117.6 |
| 4,153,109 | 5/1979 | Szescila | 166/250 |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,355 | 8/1983 | McLamore | 166/297 |
| 4,415,205 | 11/1983 | Rehm et al. | 166/50 X |
| 4,928,767 | 5/1990 | Jelsma | 166/377 |
| 5,090,496 | 2/1992 | Walker | 175/61 |
| 5,109,924 | 5/1992 | Jurgens et al. | 166/117.6 |
| 5,113,938 | 5/1992 | Clayton | 166/117.6 |
| 5,154,231 | 10/1992 | Bailey et al. | 166/117.6 |
| 5,168,941 | 12/1992 | Krueger et al. | 175/26 |
| 5,287,921 | 2/1994 | Blount et al. | 166/117.6 |
| 5,318,132 | 6/1994 | Odorisio | 166/181 X |

FOREIGN PATENT DOCUMENTS

| | | | |
|---|---|---|---|
| 2201246 | 10/1990 | United Kingdom | G01P 15/13 |
| 2185580 | 11/1990 | United Kingdom | E21B 47/022 |
| 2233363 | 9/1992 | United Kingdom | E21B 7/08 |
| 8202417 | 7/1982 | WIPO | E21B 7/06 |
| 9403697 | 2/1994 | WIPO | E21B 7/08 |
| 9403698 | 2/1994 | WIPO | E21B 7/08 |
| 9403699 | 2/1994 | WIPO | E21B 7/08 |
| 9403701 | 2/1994 | WIPO | E21B 43/00 |
| 9403702 | 2/1994 | WIPO | E21B 43/00 |

*Primary Examiner*—Roger J. Schoeppel
*Attorney, Agent, or Firm*—William M. Imwalle; Paul I. Herman

[57] ABSTRACT

A whipstock and whipstock anchor that allows for select orientation of the whipstock, retrievability of the whipstock, and also resetting of the whipstock in select orientation. The whipstock is for use in drilling a cased subterranean well with a drill bit. The whipstock includes a first device that directs the drill bit. The first device is supported at a desired location along the well casing by a second device. The first device and second device incorporate mechanisms that allow selective orientation of the first device with respect to the second device. The orientation of the second device in its location along the well casing can be accurately detected, and the mechanisms that allow selective orientation of the first device with the second device can be adjusted to provide an accurate, desired orientation for diverting a drill bit or other tool as it contacts the first device. The first device of the whipstock is retrievable and may be run multiple times to the same wellbore location to provide multiple orientations for creating wellbore bends and branching.

15 Claims, 2 Drawing Sheets

ORIENTING, RETRIEVABLE WHIPSTOCK ANCHOR

This is a continuation of application Ser. No. 08/367,483 filed on Dec. 30, 1994, now abandoned, which is a continuation, of application Ser. No. 08/186,346, filed Jan. 25, 1994, abandoned,.

BACKGROUND OF THE INVENTION

1. Field of the Invention

The invention generally relates to whipstock mechanisms for use in drilling subterranean wells, and more particularly, relates to a whipstock device and an anchor for the whipstock, which anchor may be run into the wellbore with the well casing and allows for select setting and orientation of the whipstock downhole and for retrieval of the whipstock, as desired. The invention includes both the apparatus and method of operation.

2. Description of the Related Art

Whipstocks are commonly known and used equipment in the drilling of subterranean petroleum wells. A whipstock is a device which is positioned downhole within a wellbore to change the direction of the drilling bit. Whipstocks are often used in instances in which particular wellbore direction is desired, to direct the drill bit during drilling operations. The whipstock is placed in the wellbore at a desired location where a whipstock anchor retains and prevents downward movement of the whipstock. Drilling while employing a whipstock has been commonly referred to as directional drilling because the whipstock causes the drill bit to be directed in a desired direction causing the wellbore path to deviate in a desired configuration.

It is very important in drilling subterranean wells to obtain a well hole particularly directed along a desired path. Direction of the well hole is often of utmost importance, in particular, in the case of subterranean petroleum wells. Petroleum (i.e. oil and natural gas) is often found in very unsymmetrically shaped subsurface formations. Only if a petroleum well hole is directed into specific locations within the surface formations will the well be successful for producing petroleum from the formation.

In addition to advantages of directing well holes into specific subsurface formations, it is often advantageous to have the capability to selectively cause a well hole to deviate in its subterranean path. Deviation of the well hole is important, for example, in many of the newer well drilling practices, such as horizontal drilling. In horizontal drilling, a vertical wellbore is drilled to a desired subsurface level, at which level the wellbore is directed generally horizontally through a subsurface formation. Many other diversely configured wellbore arrangements are desired for particular applications due to differing sedimentary properties and desired well production arrangements.

As previously mentioned, whipstocks have been employed in the past to cause the direction of wellbore drilling to deviate in desired directions. In those applications, a whipstock has typically been located within a wellbore at a desired location and permanently affixed there within the wellbore. Whipstocks have been fixed within the wellbore by a packer means or some other means for wedging the devices for securement at the desired locations. The prior art whipstock mechanisms have at least two significant problems. First, the prior art whipstocks are typically not easily selectively oriented. Second, the prior art whipstocks have not generally been easily retrievable from within the wellbore.

Orientation of the prior art whipstocks is a problem because it is hard, if not impossible, to selectively fix and/or detect orientation of the whipstock when located and secured downhole within a wellbore. A number of prior art means have been employed to orient whipstocks. These means include radioactive detection means or a gyroscope type means. Those prior art means for orienting a whipstock typically have been employed to orient the whipstock device in a permanent packer located in the wellbore. In those arrangements, the whipstock is secured with the permanent packer within the wellbore. The orientation of the whipstock is, thus, dictated by the placement and orientation of the packer. Select packer orientation has been hard, if not impossible, to achieve in the prior art devices. This is because the packer must be manipulated from the surface, generally very remote from the packer location downhole, to the desired orientation. Accuracy of the orientation is, therefore, generally limited. Though the prior art means have achieved some degree of orientation accuracy of whipstocks, greater accuracy is desired. Additionally, only a single orientation of the prior art whipstock device is possible at each packer location because a single orientation is set at the outset by design of the whipstock and packer mechanisms. Even further, orienting a whipstock in these prior art manners is complicated by the fact that these orienting means and packers often become lodged in the wellbore other than as desired. Orientation of the prior art whipstocks, due to the operations and configurations of the prior art orienting means, is, thus, quite problematic.

As for retrieval, the prior art whipstock orienting means and the prior art whipstocks have typically not been retrievable once placed and secured within a wellbore. Previously, a whipstock has been set within the wellbore on what is referred to as a permanent packer. In locating and securing the whipstock downhole in a wellbore, the permanent packer is first set. The whipstock is then run into a receptacle therefor incorporated with the permanent packer. The permanent packer typically has been set in an orientation detected from the surface. Such a permanent packer is not easily retrievable from the wellbore, so retrieval of the whipstock and other manipulations thereof are complicated.

The present invention is an orienting, retrievable whipstock anchor which allows a whipstock to be selectively located and oriented within a wellbore. The invention provides quite accurate location and orientation of the whipstock, and so overcomes the problems with the prior art operations and equipment for whipstock orientation downhole in a wellbore. Additionally, the invention allows for retrieval and resetting of the whipstock, as desired. Because the prior art whipstock devices have not overcome these problems of orientation and retrieval, the present invention which overcomes these problems is a significant improvement in the technology and art.

SUMMARY OF THE INVENTION

In one embodiment, the invention is a device for use in drilling a subterranean well cased by well casing, with a drill bit. The device includes first means for directing the drill bit, second means for supporting the first means at a desired location along the well casing, and means for selectively orienting the first means with respect to the second means to cause the drill bit to be selectively diverted as the drill bit contacts the first means.

In another aspect, the device further comprises means for detecting an orientation of the second means, allowing for the selective orientation of the first means.

In yet another aspect, the means for selectively orienting is incorporated with the first means.

In even another aspect, the second means is run and located within the well via the well casing.

In a further aspect, the first means includes a whipstock angled face.

In an even further aspect, the well has an upper end and a lower end and the first means engages with the second means to prevent the first means from moving further towards the lower end.

In another aspect, the first means is retrievable towards the upper end from engagement with the second means.

In even another aspect, the well has an upper end and a lower end and the first means engages with the second means to prevent the first means from moving further towards the lower end and the first means is retrievable towards the upper end from engagement with the second means.

In another embodiment, the invention is a method of drilling a subterranean well, with a drill bit, said well being cased by a well casing. The invention comprises the steps of locating a means for supporting, at a desired location along the well casing, engaging a means for diverting with the means for supporting, selectively orienting the means for diverting with respect to the means for supporting, and contacting the means for diverting with the drill bit.

In another aspect, the step of locating is performed via the well casing.

In yet another aspect, the method further comprises the step of detecting an orientation of the means for supporting, to allow for the selectively-orienting the means for diverting with respect to the means for supporting.

In even another aspect, the means for diverting includes a whipstock angled face.

In a further aspect, the well has an upper end and a lower end and the step of engaging prevents the means for diverting from moving further towards the lower end.

In yet a further aspect, the well has an upper end and a lower end and the step of engaging prevents the means for diverting from moving further towards the lower end and the means for diverting is retrievable towards the upper end from engagement with the means for supporting.

In yet a further aspect, the step of selectively orienting is performed by the means for diverting.

In even a further aspect, the means for diverting is retrievable towards the upper end from engagement with the means for supporting.

The invention also includes the product wellbores obtained for the invention methods.

BRIEF DESCRIPTION OF THE DRAWINGS

For a more complete understanding of the present invention and for further objects and advantages thereof, references may now be had to the following description in conjunction with the accompanying drawings, in which.

DETAILED DESCRIPTION OF THE INVENTION

The present invention provides a much improved apparatus and method for location and select orientation of a whipstock within a subterranean wellbore. The prior art apparatus and methods have not been precisely orientable and have not been easily retrievable. The present invention overcomes the prior art problems and provides a selectively orientable and easily retrievable whipstock device.

Figure 1:
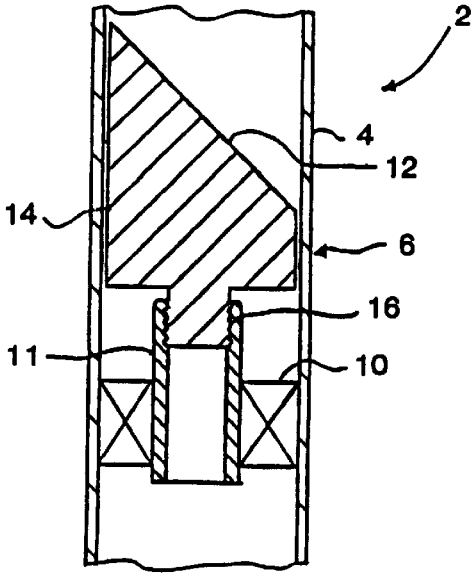
FIG. 1 (PRIOR ART)
FIG. 1 is a longitudinal cross-sectional view through a wellbore containing an exemplary prior art whipstock device, secured and oriented within a wellbore by a permanent packer.

Referring first to FIG. 1, a cross-sectional view through a wellbore containing a prior art whipstock device is simply illustrated. The wellbore 2 is seen to be cased by well casing 4. This section of the wellbore 2 would be located at a subterranean location 6 of the wellbore 2. At this location 6 within the wellbore 2, a permanent packer 10 is secured to the well casing 4. The permanent packer 10 contains a receptacle 11. The receptacle 11 of the permanent packer 10 serves to accept a whipstock device.

Continuing to refer to FIG. 1, once the permanent packer 10 is securely set within the wellbore 2 at a desired location along the well casing 4, the whipstock mandrel 14 is lowered downhole. The whipstock mandrel 14 includes an angled face 12 on the upper end of the whipstock mandrel 14. At the lower end of the whipstock mandrel 14 is a section with wrench latch threads 16. The receptacle 11 of the permanent packer 10 includes threadings at its upper end for joining with the wrench latch threads 16 of the whipstock mandrel 14.

Still referring to FIG. 1, the whipstock mandrel 14 is secured with the permanent packer 10 via the wrench latch threads 16 in the receptacle 11. The whipstock mandrel 14 is oriented by virtue of the permanent packer 10 position downhole and the positioning of the wrench latch threads 16 within the receptacle 11. The orientation may be varied, as desired, within some range of degree of accuracy, so that the angled face 12 of the whipstock mandrel 14 will deflect a drill bit lowered through the well casing 4 to pierce the well casing 4 and divert the wellbore 2 at an angle away from the sidewall of the well casing 4.

Further referring to FIG. 1, note that the whipstock mandrel 14 and permanent packer 10 have no inherent means for variably orienting the angled face 12 of the whipstock mandrel 14. The orientation achieved is dictated by the packer 10 and whipstock mandrel 14 design, the positioning of the packer 10 within the wellbore 2, and the positioning of the whipstock mandrel 14 within the packer 10. Prior art means as previously described, for example, radioactive detection means or gyroscopic type means, are necessary to determine whether the whipstock mandrel 14 has been appropriately secured with the packer 10. The selectivity of the packer 10 positioning within the wellbore 2, however, is limited in the prior art device because the orientation of the packer 10 must be controlled from the terranean surface, which, of course, is usually very remote from the downhole packer 10 location. It is hard, if not impossible, to make an accurate detection of the packer 10 orientation within very close tolerance from such a remote location with presently available means. Because selectivity of packer 10 orientation is limited in the prior art device, improvement of the means and methods for orienting prior art whipstock devices would be advantageous.

Further, still referring to FIG. 1, the prior art whipstock device is not easily retrievable. The permanent packer 10 is intended to remain within the wellbore 2 at the set location along the well casing 4. Removal of such a permanent packer 10 is, thus, not easily accomplished. Even further, removal of the whipstock mandrel 14 from securement with the receptacle 11 of the permanent packer 10 is complicated by the fact that the whipstock mandrel 14 is not easily grasped and released from the receptacle 11 due to the wrench latch threads 16. Those skilled in the art will readily observe that a more easily retrievable whipstock device, which would allow for removal and resetting at a desired location and orientation, would be a significant advantage.

Figure 2:
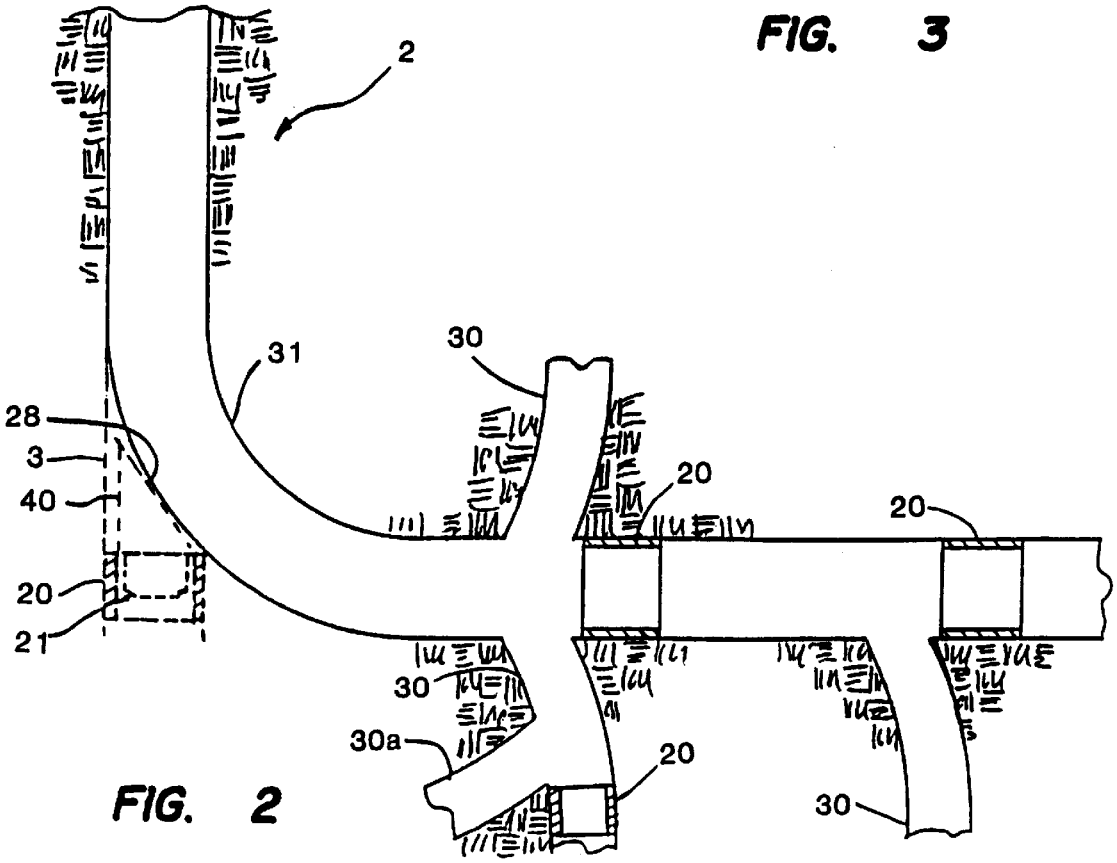
FIG. 2 is a vertical cross-sectional view through an exemplary subterranean wellbore illustrating branching of the wellbore direction, made possible by the present invention.

Referring now to FIG. 2, a cross-sectional view through an exemplary subterranean wellbore 2 is shown. The subterranean wellbore 2 has various branches 30. The exemplary subterranean wellbore 2 also includes a bend 31. As will be hereinafter more fully described, the present invention allows for drilling of a wellbore 2 having both desired bends 31 and branches 30. The present invention allows for both bends 31 and branches 30 due to the select locating, orienting and retrieval characteristics of the invention.

Still referring to FIG. 2, a bend 31 is formed in a wellbore 2 by drilling in a fixed direction beyond the desired location of the bend 31. This section of the wellbore 2 beyond the desired location of the bend 31 is illustrated in phantom as segment 3 in FIG. 2. Within the segment 3 is located a "SELECT-20"®0 orienting, retrievable whipstock anchor 20 of the present invention. The whipstock anchor 20 is run with casing 4 (not shown in detail in FIG. 2) of the wellbore segment 3. Once the whipstock anchor 20 is run to a desired location within the casing 4, the present invention whipstock device 21 is lowered into the wellbore 2 until secured with the whipstock anchor 20. Due to the particular configuration of the whipstock anchor 20 and the whipstock device 21 of the present invention, the whipstock device 21 is selectively oriented within the segment 3 so that the whipstock angled face 28 of the whipstock device 21 will direct a drill bit proceeding through the wellbore 2 in a desired directional path. As is apparent in FIG. 2, once the whipstock device 21 is so located in the whipstock anchor 20, a drill bit proceeding through the wellbore 2 will be diverted as it contacts the whipstock angled face 28 of the whipstock device 21 and will proceed through the well casing 4 wall at a varied angle from the preceding wellbore 2 path, to create a bend 31 in the wellbore 2 path.

Continuing to refer to FIG. 2, proceeding further down the wellbore 2, branches 30 of the wellbore 2 may be desired. Wellbore 2 branches 30 are illustrated in simplified form in FIG. 2. Branches 30 may be formed by locating a "SELECT-20"® orienting, retrievable whipstock anchor 20 within the wellbore 2 just downhole from the desired location of a branch 30. As well casing 4 (not shown in detail in FIG. 2) is run into the wellbore 2, one or more whipstock anchors 20, according to desired wellbore 2 configuration, may be run with the casing 4 and thereby located just beyond the desired location of branches 30. Once the whipstock anchors 20 are so located, a whipstock device 21 may be lowered into each anchor 20 and selectively oriented therein, as will be hereinafter more fully explained. Once the whipstock device 21 is oriented, an angled face 28 of the whipstock device 21 will cause a drill bit proceeding through the wellbore 2 to be directed from the preceding general path of the wellbore 2 in a desired manner creating a branch 30. Because the present invention whipstock device 21, by virtue of the present invention whipstock anchor 20, may be oriented downhole in any desired manner, multiple branches 30 may be created at any desired location within the wellbore 2. As also illustrated in FIG. 2, sub-branches 30*a* may even be drilled off branches 30 in like manner. Multiple branches 30 and sub-branches 30*a* are possible due to the select orientability and easy retrievability of the present invention.

Figure 3:
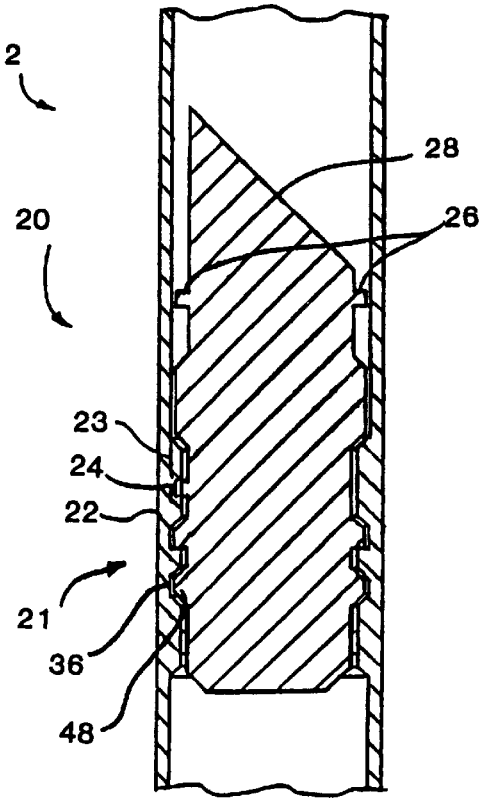
FIG. 3 is a simplified, longitudinal cross-sectional view through a wellbore containing the "SELECT-20" orienting, retrievable whipstock anchor of the present invention with whipstock in place therein, illustrating the mechanisms which provide for select orientation and retrievability.

Next referring to FIG. 3, a simplified cross-sectional illustration of the orienting, retrievable whipstock anchor 20 and whipstock device 21 of the present invention is shown. From this simplified illustration, the general concepts of locating and orienting the device 21 can be best understood. The whipstock anchor 20 includes a cylindrical casing nipple 22 having key profiles 36 along the inner circumference thereof. The casing nipple 22 also has a nipple orienting groove 23 therein. The casing nipple 22 is configured to join and run with well casing 4 (not shown in FIG. 2) as a well is being cased during drilling. The nipple 22 can be located at a desired subterranean location within a wellbore 2 (not shown in FIG. 3) in this manner.

Still referring to FIG. 3, once a casing nipple 22 is run on well casing 4 into a wellbore 2 to a desired depth, the orientation of the nipple orienting groove 23 is detected by at least one of a variety of means. Those means can, for example, include radioactive detection. In radioactive detection of nipple 22 orientation, once the nipple 22 is installed, an electric tool string is run into the well to identify a radioactive lug of the nipple 22. By determining the position of the radioactive lug, the orientation of the nipple 22 is detected.

Continuing to refer to FIG. 3, after detecting the orientation of the casing nipple 22, appropriate actions may be taken to achieve a desired orientation of the whipstock device 21. The present invention whipstock device 21 (though not shown in detail in FIG. 3) is comprised of two portions capable of rotation and position with respect to each other. The lower portion contains an orienting lug 24 capable of meeting with the nipple orienting groove 23 of the casing nipple 22 to orient the whipstock device 21 with respect to the nipple 22. Because the two portions of the whipstock device are capable of varied respective rotation and positioning, the whipstock angled face 28 may be oriented and fixed in a desired rotational position with respect to the orienting lug 24. When the two portions of the whipstock device 21 are positioned as desired and the whipstock device 21 is lowered into the casing nipple 22 so that the orienting lug 24 meets with the nipple orienting groove 23, a known and desired orientation of the whipstock device 21 within the wellbore 2 is achieved. A preferred embodiment of the whipstock device 21 which allows for the relative rotation of the separate portions of the whipstock device 21 to achieve this select orientation is hereinafter described in detail. As will be more fully understood by the description of the preferred embodiment, the relative rotational positioning of the two portions of the whipstock device 21 also allows for multiple positioning to achieve wellbore 2 branching 30 as desired.

Figure 4:
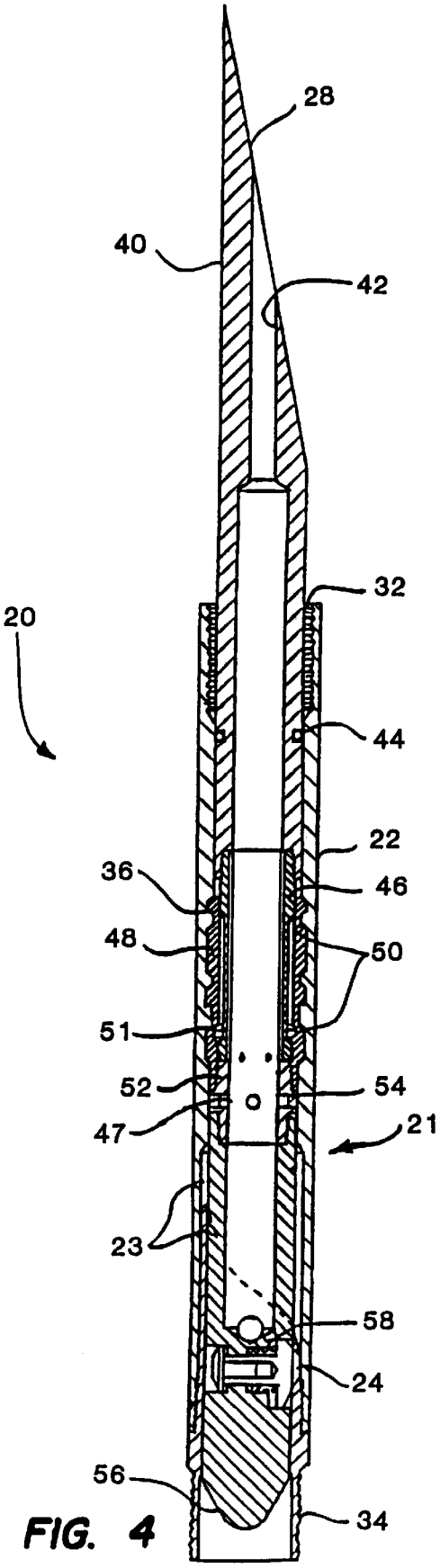
FIG. 4 is a detailed, longitudinal cross-sectional view through a preferred embodiment of the "SELECT-20"® orienting, retrievable whipstock anchor of the present invention with whipstock in place therein.

Now referring to FIG. 4, a preferred embodiment of the "SELECT-20"® orienting, retrievable whipstock anchor 20 of the present invention is illustrated in detail. The "SELECT-20"® orienting, retrievable whipstock anchor 20 includes a "SELECT-20"® casing nipple 22 that is run into a wellbore 2 (not shown in FIG. 4) with well casing 4 (not shown in FIG. 4). The casing nipple 22 joins with well casing 4 via the upper casing threads 32 and lower casing threads 34 of the nipple 22. The casing nipple 22 also includes certain key profiles 36 along the interior circumference thereof. These key profiles 36 are important because they allow a whipstock device 21 to be set and retrieved from securement at the casing nipple 22. The setting and retrieval will be more fully described hereinafter. The casing nipple 22 also includes a spiralling nipple orienting groove 23. The nipple orienting groove 23 of the casing nipple 22 is shown in the FIG. 4 cross-section in phantom, along the outer circumference of the casing nipple 22. This nipple orienting groove 23 allows for the select orientation of a whipstock device 21 secured within the casing nipple 22.

Still referring to FIG. 4, once the "SELECT-20"® casing nipple 22 is run with well casing 4 downhole to a desired location within a wellbore 2, a whipstock device 21 is lowered into the wellbore 2 to contact the casing nipple 22. The whipstock device 21 includes a fishing neck 40, a wedge mandrel 46, a locking pin mandrel 52, a keys 48 mandrel, and a bullet nose locating mandrel 56. The fishing neck 40 joins with the wedge mandrel 46 via inner threadings of the fishing neck 40 and outer threadings of the wedge mandrel 46. The locking pin mandrel 52 includes dual outer threadings. The upper outer threadings join with internal threadings of the keys 48 mandrel. The wedge mandrel 46 is internally concentric with the keys 48 mandrel, and slidingly engages therewith. The lower outer threadings of the locking pin mandrel 52 join with internal threadings of the bullet nose locating mandrel 56. The bullet nose locating mandrel 56 includes a locator section 47 that is internally concentric with the wedge mandrel 46 and may rotate (along with the entire bullet nose locating mandrel 56) with respect to the locking pin mandrel 52, keys 48 mandrel, wedge mandrel 46, and fishing neck 40. This rotation of the bullet nose locating mandrel 56 with respect to the other parts of the whipstock device 21 allows for selective and changeable orientation of the whipstock device 21.

Continuing to refer to FIG. 4, the fishing neck 40 is the uppermost portion of the whipstock device 21. The fishing neck 40 has a whipstock angled face 28. This whipstock angled face 28 serves to deflect a drill bit proceeding through a wellbore 2 when the whipstock device 21 is located in place within a casing nipple 22 in the wellbore 2. This whipstock angled face 28 may be formed of the same material as the fishing neck 40, or, in the preferred embodiment, is fixed with a significantly stronger and more durable material suitable for deflecting a drill bit, without damage to the whipstock device 21. The fishing neck 40 is also equipped with a debris hole 42. The debris hole 42 allows passage through the whipstock device 21 of drilling debris, such as rocks and other sediments, so that those materials do not back up and jam the drill bit or cause other flow problems at the whipstock device 21. The fishing neck 40 is even further equipped with a seal 44. the seal 44 maintains downhole pressures by preventing passage of fluids and pressure across the whipstock device 21. The seal 44 seals the fishing neck 40 with the inner surface of the casing nipple 22. In an alternative embodiment, the fishing neck 40 may be equipped with retrieving lugs 26 (not shown in FIG. 4, but illustrated in FIG. 3) along the outer diameter of the fishing neck 40 for retrieval of the whipstock device 21 from downhole. In the preferred embodiment described and shown, the debris hole 42 has a smaller inside diameter at the angled face 28 and, at a point downward in the fishing neck 40 body, the inside diameter becomes larger. This varied inside diameter allows retrieval of the whipstock device 21 by a retrieval tool which enters the smaller inside diameter portion and then expands at the larger inside diameter portion.

Further still referring to FIG. 4, the wedge mandrel 46 is secured with the fishing neck 40 by threadings. The wedge mandrel 46 includes one or more angled shoulders 50. These angled shoulders 50 allow the wedge mandrel 46 to selectively shift in relation to the keys 48 as will be hereinafter more fully explained. This shifting of the wedge mandrel 46 with respect to the keys 48 allows for securement of the whipstock device 21 within the casing nipple 22 at the key profiles 36 of the casing nipple 22.

Even further referring to FIG. 4, the locking pin mandrel 52 is seen to join with the keys 48 mandrel and the bullet nose locating mandrel 56. The keys 48 extend upward from the locking pin mandrel 52 and are outwardly concentric with the wedge mandrel 46. The keys 48 include certain outer ridges which conform with the key profiles 36 of the casing nipple 22. The keys 48 also include a retention groove 51 which accepts and conforms with an angled shoulder 50 of the wedge mandrel 46. When the whipstock device 21 is being run into the wellbore 2 for location at the casing nipple 22, the angled shoulder 50 of the wedge mandrel 46 is located in place within the retention groove 51 of the keys 48. When so located, the keys 48 can ride within the well casing 4 until the casing nipple 22 is reached. Once the casing nipple 22 is reached, the keys 48 move outward to become positioned within the key profiles 36 of the casing nipple 22. Once the keys 48 locate within the key profiles 36, continued downward movement of the fishing neck 40 and wedge mandrel 46 causes the wedge mandrel 46 to move downward in relation to the keys 48. The angled shoulder 50 becomes dislocated from the retention groove 51 of the keys 48, and the angled shoulders 50 of the wedge mandrel 46 lodge beneath the keys 48 in a manner causing the keys 48 to fixedly wedge against the key profiles 36.

Further still referring to FIG. 4, the locking pin mandrel 52 also includes one or more locking pins 54. These locking pins 54 serve to provide select orientation of the fishing neck 40, wedge mandrel 46, and bullet nose locating mandrel 56, with respect to the locking pin mandrel 52. This orientation of the dual assemblies provides the select orientation obtainable by the whipstock device 21. The upper assembly may be rotated as desired to provide the desired angled face 28 with respect to the position of the orienting lug 24, thereby allowing accurate and selective directional drilling. The locking pins 54 of the locking pin mandrel 52 are removable and replaceable so that the upper assembly may be positioned in a particular manner for particular directional drilling, then, the entire whipstock device 21 may be removed and the locking pins be released and the two assemblies reoriented. In this manner, multiple branches 30 (see FIG. 2) are possible from a single downhole location.

Further still referring to FIG. 4, the locking pin mandrel 52 joins with the bullet nose locating mandrel 56. The bullet nose locating mandrel 56 has at its lowermost tip a spherical point which better helps to position the whipstock device 21 to enter the casing nipple 22. The casing nipple 22 below the key profiles 36 has a nipple orienting groove 23. The nipple orienting groove spirals along the inner circumference of the nipple casing 22. This nipple orienting groove 23 serves to orient the whipstock device 21 within the nipple casing 22. The bullet nose locating mandrel 56 includes an orienting lug 24. The orienting lug 24 is formed to meet with the nipple orienting groove 23 causing the bullet nose locating mandrel 56 to be particularly located as it moves down into set position within the casing nipple 22. The orienting lug 24 is caused to move outward into the nipple orienting groove 23 as the orienting lug 24 meets the groove 23, by means of a spring 58.

The prior description of FIG. 4 discusses a preferred embodiment of the present invention. Those skilled in the art will appreciate that numerous alternative embodiments of the invention are possible and, that, though the description refers to the preferred embodiment, all alternatives are intended to be included in and to form the invention.

Figure 5:
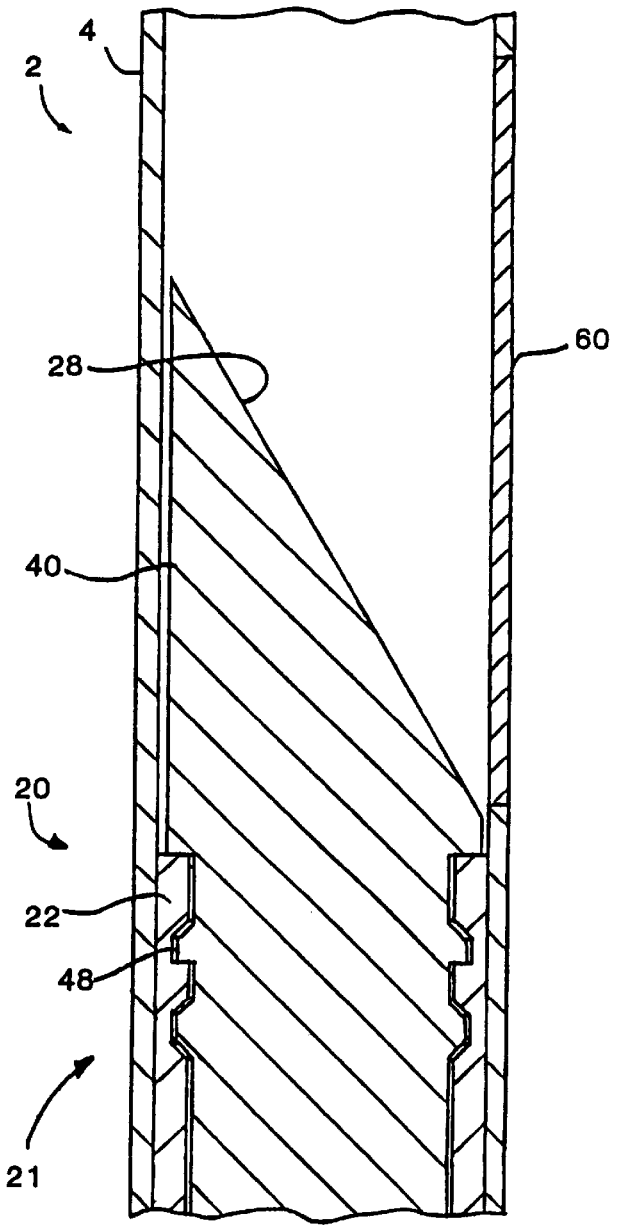
FIG. 5 is a simplified, longitudinal cross-sectional view through a wellbore casing containing the "SELECT-20"® orienting, retrievable whipstock anchor of the present invention with whipstock in place therein, wherein the wellbore casing is incorporated with a different material to assist the whipstock in providing a select orientation of a drill bit to achieve a desired directional wellbore.

Now referring to FIG. 5, an alternative embodiment of the present invention is illustrated. In this alternative embodiment, the same type of whipstock device 21 and "SELECT-20"® orienting, retrievable whipstock anchor 20 is employed. Note, however, that the well casing 4 at the whipstock angled face 28 is formed of a different material 60. In this alternative embodiment, the different material 60 could alternatively form a portion of the casing nipple 22. In any event, the different material 60 is oval shaped and is present in the sidewall of the wellbore 2 (whether well casing 4 or casing nipple 22 at the location). This different material 60 can be formed of a less strong material than the well casing 4 or casing nipple 22, as the case may be, and serves to promote directional movement of the drill bit as it encounters the angled face 28. The drill bit better pierces the different material 60 at an angle from the preceding wellbore 2 path since the different material 60 is a less strong material than that of the rest of the wellbore 2 wall.

The herein described preferred embodiment of the "SELECT-20"® orienting, retrievable whipstock anchor 20 and whipstock device 21, and the numerous alternative embodiments and variations thereof described herein or otherwise apparent to those skilled in the art, thus, provide for advantages over the prior technology. In the manufacture of the anchor 20 and device 21, all parts are preferably formed of materials such as solid, strong steel, iron, composition, or combinations thereof. The parts are also preferably cast and precision machined to provide for maximum strength and appropriate tolerances.

As is clearly seen, the present invention provides significant advantages in the technology. The present invention is believed to be especially effective when manufactured and employed as described herein, however, those skilled in the art will readily recognize that numerous variations and substitutions may be made in the device and method and its use, steps, and manufacture to achieve substantially the same results achieved by the embodiments and, in particular, the preferred embodiment expressed and described herein. Each of those variations is intended to be included in the description herein and forms a part of the present invention. The foregoing detailed description is, thus, to be clearly understood as being given by way of illustration and example only, the spirit and scope of the present invention being limited solely by the appended claims.

What is claimed is:

1. A system for use in directionally drilling a branch wellbore along a desired deviated angle from a main wellbore comprising:

(a) a casing nipple adapted to form a section of a casing string in the main wellbore, the nipple having internal structure defining a spiral orienting groove and a locking key profile;

(b) a whipstock sized to move through the casing string, the whipstock having a lower assembly, an upper assembly, and a coupling assembly rotatably connecting the lower and upper assemblies for positioning the upper assembly at a desired angle of rotation with the lower assembly including means for locking the upper and lower assemblies at the desired angle;

(c) means on the upper assembly defining a drill bit deflection face;

(d) an orienting lug on the lower assembly to engage the orienting groove of the casing nipple to position the whipstock device at a desired angle of rotation in the nipple; and (e) a locating and locking key assembly on the whipstock engageable with the key profile of the casing nipple to releasably lock the whipstock in the casing nipple.

2. A system in accordance with claim 1 wherein the key assembly is mounted on the upper assembly of the whipstock.

3. A system in accordance with claim 2 wherein the coupling means of the whipstock includes a locking pin mandrel and radially movable locking pins for releasably locking the upper and lower assemblies at the desired positions of rotation to orient the drill bit deflection face on the upper assembly at the desired angle.

4. A system in accordance with claim 3 wherein the upper assembly includes a fishing neck and the drill bit deflection face is formed on the fishing neck and the fishing neck includes a debris hole to disburse drilling debris.

5. A system in accordance with claim 4 wherein the lower assembly includes a bullet nose shaped locating mandrel for guiding the whipstock along a well casing.

6. A system in accordance with claim 5 wherein the orienting lug of the lower assembly is a spring loaded outwardly biased laterally movable lug engageable in the orienting groove of the casing nipple.

7. A system in accordance with claim 6 wherein retrieving lugs are formed on the fishing neck of the upper assembly for retrieval of the whipstock from a wellbore.

8. A system in accordance with claim 1 for use in drilling a plurality of branch wellbores from the main wellbore wherein a plurality of casing nipples form sections in tandem along a casing string in the main wellbore, each of the nipples being located at a desired position for one of the branch wellbores, the locking key profiles of the casing nipples differing each from the other and the key assembly on the whipstock being sequentially fitted to provide keys compatible with each of the nipple locking key profiles to permit the whipstock to be sequentially releasably locked at each of the nipples for drilling a branch wellbore from each nipple.

9. A system according to claim 1 including a casing string drill section located adjacent to the deflection face on the whipstock when the whipstock is landed and locked in the casing nipple, the drill section being of a more drillable material than the remainder of the casing string.

10. A whipstock for drilling a deviated wellbore from a main wellbore comprising:

(a) a fishing neck provided with a drill bit deflection face on one end;

(b) a wedge mandrel connected at one end into the opposite end of the fishing neck;

(c) a tubular key mandrel mounted around the wedge mandrel;

(d) a tubular locking pin mandrel connected at one end with the key mandrel;

(e) a tubular locating mandrel connected with the other end of the locking pin mandrel;

(f) a laterally movable orienting lug in the locating mandrel for rotatably positioning the whipstock in a casing nipple, the lug being engageable with an internal locating recess provided in the casing nipple;

(g) changeable locating and locking keys mounted on the key mandrel provided with external key profiles adapted to land and lock at a compatible key profile in a casing nipple; and (h) the locating mandrel and orienting lug being rotatable relative to the fishing neck, key mandrel, and wedge mandrel for rotating and locking the fishing neck relative to the locator mandrel for selectively positioning the drill bit deflection face on the fishing neck.

11. A system for drilling a deviated wellbore from a main wellbore comprising the whipstock of claim 10 in combination with a casing nipple adapted to be installed in a well casing in the main wellbore, the casing nipple being provided with a spiral locating groove engageable by the orienting lug on the locating mandrel and an internal landing and locking key profile engageable by the keys on the key mandrel.

12. A system in accordance with claim 11 including a plurality of landing nipples connected in tandem in the well casing for drilling a plurality of branch wellbores from the main wellbore, the landing nipples each having an orienting groove and a landing and locking key profile, the whipstock being fitted for changeable landing and locking keys compatible with each of the landing and locking key profiles in each of the casing nipples for sequentially drilling each of the deviated wellbores with the whipstock.

13. A whipstock for use in directionally drilling a branch wellbore along a desired deviated angle from a main wellbore comprising:

(a) a lower assembly, an upper assembly, and a coupling assembly rotatably connecting the lower and upper assemblies for positioning the upper assembly at a desired angle of rotation with the lower assembly including means for locking the upper and lower assemblies at the desired angle;

(b) means on the upper assembly defining a drill bit deflection face;

(c) an orienting lug on the lower assembly to engage an internal orienting groove in a nipple along a casing in the main wellbore to position the whipstock at a desired angle of rotation in the nipple; and (d) a locating and locking key assembly on the whipstock adapted to engage an internal landing and locking key profile of the casing nipple to releasably lock the whipstock in the casing nipple.

14. A method of drilling a plurality of branch wellbores from a main wellbore in accordance with the method of claim 13 wherein a plurality of casing nipples are connected in tandem in the well casing installed in the main wellbore, each of the casing nipples being located at a position for drilling a branch wellbore from the main wellbore and each of the casing nipples having a different internal landing and locking key profile for selectively landing and locking the whipstock at each of the casing nipples; and the whipstock being sequentially provided with locking keys compatible with the internal landing and locking key profiles of each of the casing nipples as each branch wellbore is drilled, and the whipstock being retrieved to the surface and the upper and lower assemblies of the whipstock being rotated and locked relative to the other as each branch wellbore is drilled to set the desired angle of rotation of the locating key on the location assembly of the whipstock relative to the bit deflection surface on the fishing neck assembly of the whipstock for properly positioning the bit deflection surface at the location of each branch wellbore.

15. A method for drilling a branch wellbore a main wellbore comprising the steps of:

(a) setting casing in the main wellbore;

(b) including a casing nipple in the casing at the depth of the branch wellbore, the nipple having an orienting groove and a landing and locking key recess for landing and locking keys on a whipstock;

(c) running into the main wellbore a whipstock having a locating assembly provided with a locating key engageable in the groove of the casing nipple and landing and locking keys engageable with the key recess of the casing nipple and a fishing neck assembly having a drill bit deflection face, the locating assembly and the fishing neck assembly of the whipstock being rotatable relative to each other and lockable at positions of rotation to permit adjustment of the angle of the bit deflection face relative to the locating key; and lowering a drill string with a drill bit through the existing wellbore until the drill bit engages the deflection face of the whipstock to drill the branch wellbore.

* * * * *